US005998350A

United States Patent [19]

Burns et al.

[11] Patent Number: 5,998,350

[45] **Date of Patent: *Dec. 7, 1999**

[54] BLEACHING COMPOUNDS COMPRISING N-ACYL CAPROLACTAM AND/OR PEROXY ACID ACTIVATORS

[75] Inventors: Michael Eugene Burns, West Chester; Alan David Willey; Jerome Howard Collins, both of Cincinnati, all of Ohio; Richard Timothy Hartshorn, Newcastle upon Tyne, United Kingdom; Chanchal Kumar Ghosh, West Chester, Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/709,072

[22] Filed: Sep. 6, 1996

Related U.S. Application Data

[63] Continuation-in-part of application No. 08/196,322, Feb. 15, 1994, abandoned, and a continuation-in-part of application No. 08/383,636, Feb. 6, 1995, abandoned, and a continuation-in-part of application No. 08/465,045, Jun. 6, 1995, abandoned, which is a continuation of application No. 08/064,624, May 20, 1993, abandoned, said application No. 08/196,322, Feb. 15, 1994, is a continuation-in-part of application No. 08/151,316, Nov. 12, 1993, abandoned, which is a continuation-in-part of application No. 08/133,691, Oct. 7, 1993, abandoned, which is a continuation-in-part of application No. 08/064,563, May 20, 1993, abandoned, said application No. 08/383,636, Feb. 6, 1995, is a continuation of application No. 08/226,915, Apr. 13, 1994, Pat. No. 5,405,412, which is a continuation-in-part of application No. 08/064,624, May 20, 1993, abandoned.

[51] Int. Cl.[6] ..... C11D 3/28; C11D 3/395; C11D 3/34; C11D 3/02

[52] U.S. Cl. ..... 510/320; 510/321; 510/367; 510/372; 510/378; 510/392; 510/530; 252/186.39

[58] Field of Search ..... 510/376, 372, 510/378, 367, 320, 321, 392, 530; 252/186.39

[56] References Cited

U.S. PATENT DOCUMENTS

| | | | |
|---|---|---|---|
| 3,177,148 | 4/1965 | Bright et al. . | |
| 4,013,575 | 3/1977 | Custrantas et al. . | |
| 4,207,199 | 6/1980 | Perner et al. . | |
| 4,412,934 | 11/1983 | Chung et al. . | |
| 4,541,944 | 9/1985 | Sanderson . | |
| 4,545,784 | 10/1985 | Sanderson . | |
| 5,030,378 | 7/1991 | Venegas . | |
| 5,112,514 | 5/1992 | Bolkan | 252/186.39 |
| 5,160,655 | 11/1992 | Donker | 252/186.38 |
| 5,405,412 | 4/1995 | Willey et al. | 252/186.39 |
| 5,405,413 | 4/1995 | Willey et al. | 252/186.39 |
| 5,503,639 | 4/1996 | Willey et al. | 252/186.39 |
| 5,686,401 | 11/1997 | Willey et al. | 510/313 |

FOREIGN PATENT DOCUMENTS

| | | | |
|---|---|---|---|
| 122 763 | 10/1984 | European Pat. Off. | C11D 3/39 |
| 283252 | 9/1988 | European Pat. Off. | C11D 3/39 |
| 399584 | 5/1990 | European Pat. Off. | C11D 3/39 |
| 2388924 | 12/1978 | France | D06F 35/00 |
| 1596313 | 8/1981 | United Kingdom | D06F 39/02 |
| 2189520 | 10/1987 | United Kingdom | D06L 3/16 |

*Primary Examiner*—Margaret Medley
*Attorney, Agent, or Firm*—C. Brant Cook; Kim W. Zerby; Jacobus C. Rasser

[57] ABSTRACT

The present invention relates to bleaching and detergent compositions comprising conventional detergent ingredients, bleaching systems with one or more bleach activators. Preferred bleaching activators are amido-derived bleach activators and/or N-acyl caprolactam bleach activators. The invention also relates to methods of using the detergent compositions.

30 Claims, No Drawings

BLEACHING COMPOUNDS COMPRISING N-ACYL CAPROLACTAM AND/OR PEROXY ACID ACTIVATORS

CROSS REFERENCE TO RELATED APPLICATIONS

This application is a continuation-in-part of U.S. patent application Ser. No. 08/196,322 filed Feb. 15, 1994 now abandoned, which is a continuation-in-part of U.S. patent application Ser. No. 08/151,316, filed Nov. 12, 1993, now abandoned, which is continuation-in-part of U.S. patent application Ser. No. 08/133,691 filed Oct. 7, 1993, now abandoned, which is a continuation-in-part of U.S. patent application Ser. No. 08/064,563, filed May 20, 1993, now abandoned; and is a continuation-in-part of U.S. patent application Ser. No. 08/383,636 filed Feb. 6, 1995 now abandoned, which is a continuation of U.S. patent application Ser. No. 08/226,915, filed Apr. 13, 1994, now U.S. Pat. No. 5,405,412, which is a continuation-in-part of U.S. patent application Ser. No. 08/064,627 filed May 20, 1993 now abandoned; and is a continuation-in-part of U.S. patent application Ser. No. 08/465,045 filed Jun. 6, 1995 now abandoned, which is a continuation of U.S. patent application Ser. No. 08/064,624, filed May 20, 1993, now abandoned.

FIELD OF THE INVENTION

The present invention relates to compositions and methods which employ activated bleaches.

BACKGROUND OF THE INVENTION

Various types of detersive enzymes have long been conventionally used in laundry detergents to assist in the removal of certain stains from fabrics. These stains are typically associated with lipid and protein soils. The enzymes, however, have proven less effective against other types of soils and stains.

It has also long been known that peroxygen bleaches are effective for stain and/or soil removal from fabrics, but that such bleaches are temperature dependent. At a laundry liquor temperature of 60° C., peroxygen bleaches are only partially effective. As the laundry liquor temperature is lowered below 60° C., peroxygen bleaches become relatively ineffective. As a consequence, there has been a substantial amount of industrial research to develop bleaching systems which contain an activator that renders peroxygen bleaches effective at laundry liquor temperatures below 60° C.

Numerous substances have been disclosed in the art as effective bleach activators. One widely-used activator is tetraacetyl ethylene diamine (TAED). TAED provides effective hydrophilic cleaning especially on beverage stains, but has limited performance on dingy, yellow stains such as those resulting from body oils. Fortunately, another type of activator, such as nonanoyloxybenzenesulfonate (NOBS) and other activators which generally comprise long chain alkyl moieties, is hydrophobic in nature and provides excellent performance on dingy stains.

It would seem that a combination of enzymes with either hydrophilic or hydrophobic bleach activators, or both, would provide an effective "all-around" detergent composition which would perform well on most types of soils and stains. However, a hindrance to the development of such all-around cleaning compositions has been the discovery that many of the hydrophobic bleach activators developed thus far can promote damage to natural rubber parts used in certain washing machines. Because of the negative effects on washing machine parts, the selection of such detergent-added bleaching systems has been limited. This is especially true for European detergent/bleaches, since many washing machines manufactured in Europe are equipped with key parts, such as sump hoses and motor gaskets, made of natural rubber.

Another problem in developing an all-around cleaning composition has been finding a cleaning agent that is effective under heavy soil load conditions. The removal of heavy soil levels, especially nucleophilic and body soils, has proven especially difficult for conventional bleaching systems. Under such circumstances, conventional activators such as NOBS appear to interact with, and be destroyed by, heavy soil loads before they can optimally provide their intended bleaching function. Still another problem has been the stability of enzymes, especially lipases and proteases, in the presence of bleaches.

A need, therefore, exists for compositions which provide effective cleaning performance over a wide variety of soils and stains. Moreover, the compositions should provide effective cleaning performance without substantially damaging natural rubber machine parts. In addition, the compositions should provide both bleaching performance and enzyme cleaning performance.

Without intending to be limited by theory, it is believed that typical hydrophobic bleach activators undergo a perhydrolysis reaction to form a peroxyacid bleaching agent. However, a typical by-product of the perhydrolysis reaction between conventional bleach activators and hydrogen peroxide is a diacylperoxide (DAP) species. Unfortunately, DAP species derived from hydrophobic activators tend to be insoluble, poorly dispersible, oily materials which form a residue which can deposit on the natural rubber machine parts that are exposed to the laundry liquor. The oily DAP residue can form a film on the natural rubber machine parts and promote free radical and peroxide damage to the rubber, which eventually leads to failure of the parts.

By the present invention, it has now been discovered that the class of hydrophobic bleach activators derived from amido acids forms hydrophobic amido peracids upon perhydrolysis without the production of harmful, oily DAP's. Again, while not intending to be limited by theory, it is believed that the DAP's produced by the perhydrolysis reaction of the amido acid-derived bleach activators used herein are insoluble crystalline solids. The solids do not form a coating film; therefore, the natural rubber parts are not exposed to the DAP's for extended periods of time and remain substantially undamaged.

In addition to the amido acid-derived bleach activators, it has also now been discovered that the class of bleach activators derived from N-acyl caprolactams provide both hydrophilic and hydrophobic bleaching action without the production of harmful DAP by-products.

Additionally, it has also now been discovered that the class of benzoxazin-type leach activators provide effective hydrophobic bleaching action without the production of harmful DAP by-products.

Surprisingly, it has also been discovered that certain enzymes, particularly lipase enzymes, are compatible with these classes of bleach activators.

Accordingly, the present invention solves the long-standing need for detergent compositions which provide efficient and effective performance over a wide range of cleaning needs. The invention also provides efficient and effective detergent compositions for use in washing machines which have parts made of natural rubber, such that the natural rubber is substantially undamaged by the bleaching system. These and other benefits are secured by the invention, as will be seen hereinafter.

BACKGROUND ART

U.S. Pat. No. 4,634,551, Bums et al, issued Jan. 6, 1987, discloses amido peroxyacid bleaching compounds and their precursors which are employed in the present invention. See also, U.S. Pat. No. 4,852,989, Bums et al, issued Aug. 1, 1989. U.S. Pat. No. 5,069,809, Lagerwaard et al, issued Dec. 3, 1991 discloses the combination of NOBS bleach activators with LIPOLASE, lipase enzymes. See E.P. Patent 341,947, Lagerwaard, et al, published Nov. 15, 1989 for a discussion of the compatibility problems of lipase enzymes with certain bleaching systems. U.S. Pat. No. 4,545,784, Sanderson, issued Oct. 8, 1985, discloses the absorption of activators onto sodium perborate monohydrate. U.S. Pat. No. 4,412,934, Chung et al, issued Nov. 1, 1983, discloses alkanoyloxybenzenesulfonate activators, including the preferred nonanoyloxybenzenesulfonate activator used herein.

SUMMARY OF THE INVENTION

The invention herein provides bleaching compositions and methods which are safe for use in contact with natural rubber, and which provide not only bleach performance, but also good detersive enzyme stability and performance.

The present invention encompasses bleaching compositions comprising at least about 0.1%, by weight, of a peroxygen bleaching compound and at least about 0.1%, by weight, of one or more bleach activators, wherein said bleach activators are members selected from the group consisting of:

a) a bleach activator of the general formula:

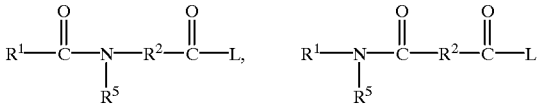

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

b) benzoxazin-type bleach activators of the general formula:

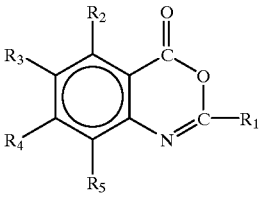

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, $COOR_6$ (wherein $R_6$ is H or an alkyl group) and carbonyl functions;

c) N-acyl caprolactam bleach activators of the formula:

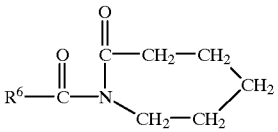

wherein $R^6$ is H or an alkyl, aryl, alkoxyaryl or alkaryl group containing from 1 to 12 carbons; and d) mixtures of a), b) and c).

Preferably, the molar ratio of hydrogen peroxide yielded by the peroxygen bleaching compound to bleach activator is greater than about 1.0. Most preferably, the molar ratio of hydrogen peroxide to bleach activator is at least about 1.5.

The present invention also encompasses compositions comprising an effective amount of one or more types of enzymes and a bleaching system comprising at least about 0.1%, preferably from about 0.1% to about 50%, by weight, of a substantially insoluble organic peroxyacid having the general formula:

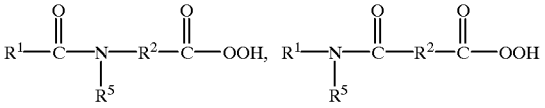

wherein $R^1$, $R^2$, and $R^5$ are as defined for the type a) bleach activator above.

Preferred bleach activators of type a) are those wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about 10 carbon atoms and $R^2$ contains from about 4 to about 5 carbon atoms.

Preferred bleach activators of type b) are those wherein R, $R_3$, $R_4$, and $R_5$ are H and $R_1$ is a phenyl group.

The preferred acyl moieties of said N-acyl caprolactam bleach activators of type c) have the formula $R^6$—CO— wherein $R^6$ is H or an alkyl, aryl, alkoxyaryl, or alkaryl group containing from 1 to 12 carbons, preferably from 6 to 12 carbon toms. In highly preferred embodiments, $R^6$ is a member selected from the group consisting of phenyl, heptyl, octyl, nonyl, 2,4,4-trimethylpentyl, decenyl and mixtures thereof.

Other highly preferred compositions are those comprising bleach activators selected from the group consisting of:

a) a bleach activator of the formula:

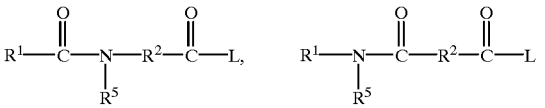

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

b) a N-acyl caprolactam bleach activator of the formula:

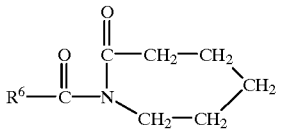

wherein $R^6$ is H or an alkyl, aryl, alkoxyaryl, or alkaryl group containing from about 1 to about 12 carbons; and c) mixtures of a) and b); and an enzyme selected from the group consisting of SAVINASE, Protease C, and mixtures thereof. Highly preferred activators include benzoyl caprolactam, nonanoyl caprolactam, (6-octanamidocaproyl)oxybenzenesulfonate, (6-nonanamidocaproyl)oxy-benzenesulfonate, (6-decanamidocaproyl)oxybenzenesulfonate, and mixtures thereof.

The peroxygen bleaching compound can be any peroxide source, and is preferably a member selected from the group consisting of sodium perborate monohydrate, sodium perborate tetrahydrate, sodium pyrophosphate peroxyhydrate, urea peroxyhydrate, sodium percarbonate, sodium peroxide and mixtures thereof. Preferred peroxygen bleaching compounds are selected from the group consisting of sodium perborate monohydrate, sodium percarbonate, sodium perborate tetra-hydrate and mixtures thereof. A highly preferred peroxygen bleaching compound is sodium percarbonate.

The amido-derived and caprolactam bleach activators herein can also be used in combination with rubber-safe, enzyme-safe, hydrophilic activators such as N-acyl caprolactams where $R^6$ is less than 6 carbon atoms or TAED, typically at weight ratios of amido-derived or caprolactam activators:hydrophilic in the range of 1:5 to 5:1, preferably about 1:1.

The compositions and uses herein are effective with all manner of detersive enzymes, e.g., members selected from the group consisting of proteases, amylases, lipases, cellulases, peroxidases and mixtures thereof. Highly preferred are lipase enzymes derived from the fungus *Humicola lanuginosa*, optionally as expressed in *Aspergillus oryzae* as host using art-disclosed genetic engineering techniques. Also highly preferred are modified protease bacterial serine protease enzymes obtained from *Bacillus subtilis, Bacillus lentus* or *Bacillus licheniformis*. The enzymes comprise at least about 0.001%, preferably from about 0.001% to about 5%, of the detergent compositions.

The present invention also includes compositions in which the activator is an N-acyl caprolactam activator where $R^6$ is 6 carbon atoms or less in conjunction with an alkanoyloxybenzenesulfonate activator. The N-acyl caprolactam is preferably selected from the group consisting of benzoyl caprolactam, formyl caprolactam, acetyl caprolactam, propanoyl caprolactam, butanoyl caprolactam, pentanoyl caprolactam, and hexanoyl caprolactam. The alkanoyloxybenzenesulfonate activator is preferably selected from the group consisting of nonanoyloxybenzenesulfonate, decanoyl-xybenzenesulfonate, octanoyloxybenzenesulfonate, dodecanoyloxybenzenesulfonate, 3,5,5-trimethylhexanoyloxybenzenesulfonate, 2-ethylhexanoyloxybenzenesulfonate, and mixtures thereof.

The invention also encompasses a method for cleaning fabrics comprising contacting, preferably with agitation, said fabrics with an aqueous liquor containing the compositions of the present invention. The method can be carried out at temperatures below about 60° C. but, of course, is quite effective and is still safe to rubber parts at laundry temperatures up to the boil. The aqueous laundry liquor comprises at least about 300 ppm of conventional detergent ingredients, as well as at least about 25 ppm of bleach activator and at least about 25 ppm of bleaching compound. Preferably, the aqueous liquor comprises from about 900 ppm to about 20,000 ppm of the conventional detergent ingredients, from about 100 ppm to about 25,000 ppm of bleaching compound and from about 100 ppm to about 2,500 ppm of the bleach activator.

The conventional detergent ingredients employed in said method comprise from about 1% to about 99.8%, preferably from about 5% to about 80%, of a detersive surfactant. Optionally, detersive compositions can also comprise from about 5% to about 80% of a detergent builder. Other optional detersive ingredients are also encompassed by the fully-formulated detergent/bleach compositions provided by this invention.

All percentages, ratios and proportions are by weight, unless otherwise specified. All documents cited are incorporated herein by reference.

DETAILED DESCRIPTION OF THE INVENTION

The compositions employed in the present invention provide effective and efficient surface cleaning of fabrics which thereby removes stains and/or soils from the fabrics. The bleaching systems are particularly efficient at removing most types of soils from the fabrics, including protein and lipid soils, dingy soils, and heavy soil loads, especially from nucleophilic and body soils.

The superior bleaching/cleaning action of the present compositions is achieved with safety to natural rubber machine parts and other natural rubber articles, including fabrics containing natural rubber and natural rubber elastic materials. The bleaching mechanism and, in particular, the surface bleaching mechanism are not completely understood. However, it is generally believed that the bleach activator undergoes nucleophilic attack by a perhydroxide anion, which is generated from the hydrogen peroxide evolved by the peroxygen bleach, to form a peroxycarboxylic acid. This reaction is commonly referred to as perhydrolysis.

The bleaching systems and activators herein afford additional advantages in that, unexpectedly, they are safer to fabrics and cause less color damage than other activators when used in the manner provided by this invention.

It is also believed that the bleach activators within the invention can render peroxygen bleaches more efficient even at laundry liquor temperatures wherein bleach activators are not necessary to activate the bleach, i.e., above about $6^0$0C.

Therefore, with bleach systems of the invention, less peroxygen bleach is required to get the same level of surface bleaching performance as is obtained with the peroxygen bleach alone.

The bleaching systems, wherein the bleach activator is used, also have as an essential component a peroxygen bleach capable of releasing hydrogen peroxide in aqueous solution.

The Bleach Activator

Amido Derived Bleach Activators—The bleach activators of type a) employed in the present invention are amide substituted compounds of the general formulas:

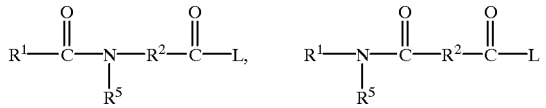

or mixtures thereof, wherein $R^1$, $R^2$ and $R^5$ are as defined above and L can be essentially any suitable leaving group. A leaving group is any group that is displaced from the bleaching activator as a consequence of the nucleophilic attack on the bleach activator by the perhydroxide anion. This, the perhydrolysis reaction, results in the formation of the peroxycarboxylic acid. Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (e.g., a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behavior are those in which their conjugate acid has a pKa in the range of from about 4 to about 13, preferably from about 6 to about 11 and most preferably from about 8 to about 11.

Preferred bleach activators are those of the above general formula wherein R, $R^2$ and $R^5$ are as defined for the peroxyacid and L is selected from the group consisting of:

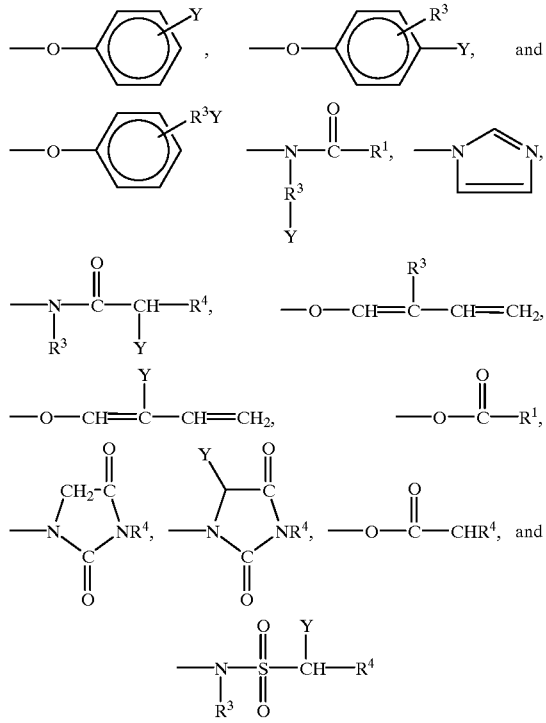

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of:

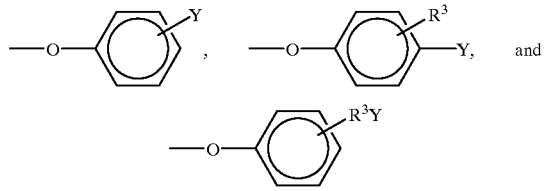

wherein $R^3$ is as defined above and Y is $—SO_3^-M^+$ or $—CO_2^-M^+$ wherein M is as defined above.

Another important class of bleach activators, including those of type b) and type c), provide organic peracids as described herein by ring-opening as a consequence of the nucleophilic attack on the carbonyl carbon of the cyclic ring by the perhydroxide anion. For instance, this ring-opening reaction in type c) activators involves attack at the caprolactam ring carbonyl by hydrogen peroxide or its anion. Since attack of an acyl caprolactam by hydrogen peroxide or its anion occurs preferably at the exocyclic carbonyl, obtaining a significant fraction of ring-opening may require a catalyst. Another example of ring-opening bleach activators can be found in type b) activators, such as those disclosed in U.S. Pat. No. 4,966,723, Hodge et al, issued Oct. 30, 1990.

Such activator compounds disclosed by Hodge include the activators of the benzoxazin-type, having the formula:

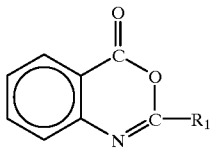

including the substituted benzoxazins of the type

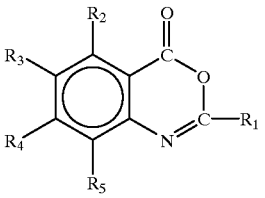

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

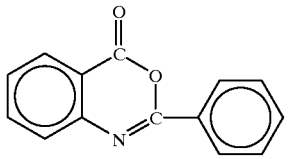

When the activators are used, optimum surface bleaching performance is obtained with washing solutions wherein the pH of such solution is between about 8.5 and 10.5 and preferably between 9.5 and 10.5 in order to facilitate the perhydrolysis reaction. Such pH can be obtained with substances commonly known as buffering agents, which are optional components of the bleaching systems herein.

The N-Acyl Caprolactam Bleach Activators—The N-acyl caprolactam bleach activators of type c) employed in the present invention have the formula:

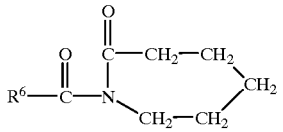

wherein R is H or an alkyl, aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above.

Caprolactam activators wherein $R^6$ comprises from 1 to about 6 carbon atoms provide hydrophilic bleaching species which are particularly efficient for bleaching beverage stains. Mixtures of hydrophobic and hydrophilic caprolactams, typically at weight ratios of 1:5 to 5:1, preferably 1:1, can be used herein for mixed stain removal benefits.

Highly preferred hydrophobic N-acyl caprolactams are selected from the group consisting of benzoyl caprolactam, octanoyl caprolactam, nonanoyl caprolactam, decanoyl caprolactam, undecenoyl caprolactam, 3,5,5-trimethylhexanoyl caprolactam, and mixtures thereof.

Highly preferred hydrophilic N-acyl caprolactams are selected from the group consisting of formyl caprolactam, acetyl caprolactam, and propinoyl caprolactam.

Benzoyl caprolactam, i.e., wherein $R^6$ is a phenyl substituent, has now been found to be unique among the bleach activator compounds, inasmuch as it appears to exhibit both hydrophobic and hydrophilic bleaching activity. This hydrophobic/hydrophilic bleaching capability makes benzoyl caprolactam the activator of choice for the formulator who is seeking broad spectrum bleaching activity, but wishes to use only a single activator to simplify formulation work.

Some bleaching and cleaning operations are conducted under usage conditions in which the aqueous laundry liquor is at a relatively high temperature, e.g., 80° C. to the boil, such as in some European-type washing machines. In such circumstances, there is some prospect that malodors may be perceived by the user. While not intending to be limited by theory, it is believed that such malodors could be caused by volatilization of straight-chain $C_6$–$C_9$ fatty acids from the spent activator compound herein. To minimize this problem, bleach activators wherein $R^6$ is a branched-chain $C_6$–$C_9$ moiety can be employed. Especially preferred for this use is 3,5,5-trimethylhexanoyl caprolactam, although other branched alkyl caprolactams can be used.

Additional bleach activators which may be employed in the present invention are alkanoyloxybenzenesulfonates of the formula:

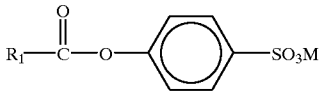

wherein $R^1$—C(O)— contains from about 8 to about 12, preferably from about 8 to about 11, carbon atoms and M is a suitable cation, such as an alkali metal, ammonium, or substituted ammonium cation, with sodium and potassium being most preferred.

Highly preferred hydrophobic alkanoyloxybenzenesulfonates are selected from the group consisting of nonanoyloxybenzenesulfonate, 3,5,5-trimethylhexanoyloxybenzene-sulfonate, 2-ethylhexanoyloxybenzenesulfonate, octanoyloxybenzenesulfonate, decanoyloxybenzenesulfonate, dodecanoyloxybenzenesulfonate, and mixtures thereof.

Methods for making N-acyl caprolactams are well known in the art.

Examples I and II, included below, illustrate preferred laboratory syntheses.

Contrary to the teachings of U.S. Pat. No. 4,545,784, cited above, the bleach activator is preferably not absorbed onto the peroxygen bleaching compound. To do so in the presence of other organic detersive ingredients could cause safety problems.

The bleach activators of type a), b) or c) will comprise at least about 0.1%, preferably from about 0.1% to about 50%, more preferably from about 1% to about 30%, most preferably from about 3% to about 25%, by weight of bleaching system or detergent composition.

When the activators are used, optimum surface bleaching performance is obtained with washing solutions wherein the pH of such solution is between about 8.5 and 10.5 and preferably between 9.5 and 10.5 in order to facilitate the perhydrolysis reaction. Such pH can be obtained with substances commonly known as buffering agents, which are optional components of the bleaching systems herein.

The Peroxygen Bleaching Compound

The peroxygen bleaching systems useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include mixtures of carbonate and sulphate, silicate, borosilicate, or fatty carboxylic acids.

The peroxygen bleaching compound will comprise at least about 0.1%, preferably from about 1% to about 75%, more preferably from about 3% to about 40%, most preferably from about 3% to about 25%, by weight of bleaching system or detergent composition.

The weight ratio of bleach activator to peroxygen bleaching compound in the bleaching system typically ranges from about 2:1 to 1:5. Preferred ratios range from about 1:1 to about 1:3.

The bleach activator/bleaching compound systems herein are useful per se as bleaches. However, such bleaching systems are especially useful in compositions which can comprise various detersive adjuncts such as surfactants, builders and the like.

The Detersive Enzymes

The detersive enzymes of the present invention are included for a wide variety of fabric laundering purposes, including removal of protein-based, carbohydrate-based, or triglyceride-based stains, for example, and for the prevention of fugitive dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 50 mg by weight, more typically about 0.01 mg to about 10 mg, of active enzyme per gram of detergent composition. Stated otherwise, an effective amount of the enzymes employed in the present invention will comprise at least about 0.001%, preferably from about 0.001% to about 5%, more preferably from about 35 0.001% to about 1%, most preferably from about 0.01% to about 1%, by weight of detergent composition.

Suitable examples of proteases are the subtilisins which are obtained from particular strains of *B.subtilis, B.lentus* and *B.licheniforms*. Another suitable protease is a modified bacterial serine protease enzyme obtained from *Bacillus subtilis* or *Bacillus licheniformis*, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985). Most preferred is what is called herein "Protease C", which is a variant of an alkaline serine protease from Bacillus, particularly *Bacillus lentus*, in which arginine replaced lysine at position 27, tyrosine replaced valine at position 104, serine replaced asparagine at position 123, and alanine replaced threonine at position 274. Protease C is described in EP 90915958:4, U.S. Pat. No. 5,185,250 and U.S. Pat. No. 5,204,015, which are incorporated herein by reference. Genetically modified variants, particularly of Protease C, are also included herein.

Amylases include, for example, a-amylases described in British Patent Specification No. 1,296,839 (Novo), RAPIDASE, International Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, 5 commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme, derived from the fungus *Humicola lanuginosa* and expressed in *Aspergillus oryzae* as host and commercially available from Novo (see also E.P. Patent 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase.

Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent granules is also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981.

Enzymes for use in detergents can be stabilized by various techniques. Enzyme stabilization techniques are disclosed and exemplified in U.S. Pat. No. 4,261,868, issued Apr. 14, 1981 to Horn, et al, U.S. Pat. No. 3,600,319, issued Aug. 17, 1971 to Gedge, et al, and European Patent Application Publication No. 0199405, Application No. 86200586.5, published Oct. 29, 1986, Venegas. Enzyme stabilization systems are also described, for example, in U.S. Pat. Nos. 4,261,868, 3,600,319, and 3,519,570.

Enzyme Stabilizers—The enzymes employed herein are stabilized by the presence of water-soluble sources of calcium ions in the finished compositions which provide calcium ions to the enzymes. Additional stability can be provided by the presence of various other art-disclosed stabilizers, especially borate species: see Severson, U.S. Pat. No. 4,537,706, cited above. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium ions. The level of calcium ion should be selected so that there is always some minimum level available for the enzyme, after allowing for complexation with builders, fatty acids, etc., in the composition. Any water-soluble calcium salt can be used as the source of calcium ion, including, but not limited to, calcium chloride, calcium sulfate, calcium malate, calcium hydroxide, calcium formate, and calcium acetate. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

The compositions herein may also optionally, but preferably, contain various additional stabilizers including silicate coatings and, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Detersive Surfactant

The amount of detersive surfactant included in the fully-formulated detergent compositions afforded by the present invention can vary from about 1% to about 99.8% depending upon the particular surfactants used and the effects desired. Preferably, the detersive surfactants comprise from about 5% to about 80% by weight of the detergent ingredients.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary, and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One particular class of adjunct nonionic surfactants especially useful herein comprises the polyhydroxy fatty acid amides of the formula:

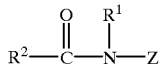

(I)

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2-(CHOH)_2(CHOR')(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If lower sudsing is desired, $R^1$ is preferably $C_2$–$C_8$ alkyl, especially n-propyl, iso-propyl, n-butyl, iso-butyl, pentyl, hexyl and 2-ethyl hexyl.

$R^2—CO—N<$ can be, for example, cocamide, stearamide, oleamide, lauramide, myristamide, capricamide, palmitamide, tallowamide, etc.

Detersive Builders

Optional detergent ingredients employed in the present invention contain inorganic and/or organic detersive builders to assist in mineral hardness control. If used, these builders comprise from about 5% to about 80% by weight of the detergent compositions.

Inorganic detersive builders include, but are not limited to, the alkali metal, ammonium and alkanolammonium salts of polyphosphates (exemplified by the tri-polyphosphates, pyrophosphates, and glassy polymeric meta-phosphates), phosphonates, phytic acid, silicates, carbonates (including bicarbonates and sesquicarbonates), sulphates, and aluminosilicates. However, nonphosphate builders are required in some locales.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, available from Hoechst under the trademark "SKS"; SKS-6 is an especially preferred layered silicate builder.

Carbonate builders, especially a finely ground calcium carbonate with surface area greater than 10 $m^2/g$, are preferred builders that can be used in granular compositions. The density of such alkali metal carbonate built detergents can be in the range of 450–850 g/l with the moisture content preferably below 4%. Examples of carbonate builders are the alkaline earth and alkali metal carbonates as disclosed in German Patent Application No. 2,321,001 published on Nov. 15, 1973.

Aluminosilicate builders are especially useful in the present invention. Preferred aluminosilicates are zeolite builders which have the formula:

$$Na_z[(AlO_2)_z(SiO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. Methods for producing aluminosilicate ion exchange materials are disclosed in U.S. Pat. No. 3,985,669, Krummel, et al, issued Oct. 12, 1976, and U.S. Pat. No. 4,605,509, Corkill, et al, issued Aug. 12, 1986. Preferred synthetic crystalline aluminosilicate ion exchange materials useful herein are available under the designations Zeolite A, Zeolite P (B) (including those disclosed in EPO 384,070), and Zeolite X. Preferably, the aluminosilicate has a particle size of about 0.1–10 microns in diameter.

Organic detersive builders suitable for the purposes of the present invention include, but are not restricted to, a wide variety of polycarboxylate compounds, such as ether polycarboxylates, including oxydisuccinate, as disclosed in Berg, U.S. Pat. No. 3,128,287, issued Ap. 7, 1964, and Lamberti et al, U.S. Pat. No. 3,635,830, issued Jan. 18, 1972. See also "TMS/TDS" builders of U.S. Patent 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detersive builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are preferred polycarboxylate builders that can also be used in granular compositions, especially in combination with zeolite and/or layered silicate builders.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Optional Detersive Adjuncts

As a preferred embodiment, the conventional detergent ingredients employed herein can be selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al, are incorporated herein by reference. Such adjuncts which can be included in detergent compositions employed in the present invention, in their conventional art-established levels for use (generally from 0% to about 20% of the detergent ingredients, preferably from about 0.5% to about 10%), include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, perfumes, solvents, solubilizing agents, clay soil removal/anti-redeposition agents, polymeric dispersing agents, processing aids, fabric softening components static control agents, etc.

Bleach systems optionally, but preferably, will also comprise a chelant which not only enhances bleach stability by scavenging heavy metal ions which tend to decompose bleaches, but also assists in the removal of polyphenolic stains such as tea stains, and the like. Various chelants, including the aminophosphonates, available as DEQUEST from Monsanto, the nitrilotriacetates, the hydroxyethylethylenediamine triacetates, and the like, are known for such use. Preferred biodegradable, non-phosphorus chelants include ethylene-diamine disuccinate ("EDDS"; see U.S. Pat. No. 4,704,233, Hartman and Perkins), ethylenediamine-N,N'-diglutamate (EDDG) and 2-hydroxypropylenediamine-N,N'-disuccinate (HPDDS) compounds. Such chelants can be used in their alkali or alkaline earth metal salts, typically at levels from about 0.1% to about 10% of the present compositions.

Optionally, the detergent compositions employed herein can comprise, in addition to the bleaching system of the present invention, one or more other conventional bleaching agents, activators, or stabilizers which do not react with or otherwise harm natural rubber. In general, the formulator will ensure that the bleach compounds used are compatible with the detergent formulation. Conventional tests, such as tests of bleach activity on storage in the presence of the separate or fully-formulated ingredients, can be used for this purpose. A specific example of an optional bleaching agent for incorporation in this invention is tetraacetyl ethylene diamine (TAED) Such bleaching compounds and agents can be optionally included in detergent compositions in their conventional art-established levels of use, generally from 0% to about 15%, by weight of detergent composition.

Bleaching activators of the invention are especially useful in conventional laundry detergent compositions such as those typically found in granular detergents or laundry bars. U.S. Pat. No. 3,178,370, Okenfuss, issued Apr. 13, 1965, describes laundry detergent bars and processes for making them. Philippine Patent 13,778, Anderson, issued Sep. 23, 1980, describes synthetic detergent laundry bars. Methods for making laundry detergent bars by various extrusion methods are well known in the art.

The following examples are given to further illustrate the present invention, but are not intended to be limiting thereof

EXAMPLE I

Synthesis of Nonanoyl Caprolactam—To a two liter three necked round bottomed flask equipped with a condenser, overhead stirrer and 250 ml addition funnel is charged 56.6 g (0.5 moles) caprolactam, 55.7 g (0.55 moles) triethylamine and 1 liter of dioxane; the resulting solution is heated to reflux (120° C.). A solution of 88.4 g (0.5 moles) nonanoyl chloride dissolved in 200 ml of dioxane is then added over 30 minutes and the mixture is refluxed for a further 6 hours. The reaction mixture is then cooled, filtered, and the solvent removed by rotary evaporation to yield 120.5 g of the product as a dark oil. This crude product is then dissolved in diethyl ether, washed with 3×50 ml aliquots of water, dried over magnesium sulphate and the solvent removed by rotary evaporation to yield 81.84 g (65% theoretical yield) of product which is shown by NMR to be 90% pure, with the remaining material being nonanoic acid.

EXAMPLE II

Synthesis of Benzoyl Caprolactam—To a two liter three necked round bottomed flask equipped with a condenser, overhead stirrer and 250 ml addition funnel is charged 68.2 g (0.6 moles) caprolactam, 70 g (0.7 moles) triethylarnine and 1 liter of dioxane; the resulting solution is heated to reflux (120° C.). A solution of 84.4 g (0.6 moles) benzoyl chloride dissolved in 200 ml of dioxane is then added over 30 minutes and the mixture is refluxed for a further 6 hours. The reaction mixture is then cooled, filtered, and the solvent removed by rotary evaporation to yield 121.7 g of the product as an oil which crystallizes on standing. This crude product is then redissolved in toluene and precipitated with hexane, yielding 103 g (79% theoretical yield) of a white solid which which is shown by NMR to be over 95% pure, with the remaining material being benzoic acid.

EXAMPLE III

Synthesis of Nonanoyloxybenzenesulfonate—A 500 ml 3-neck flask is fitted with a reflux condenser and mechanical stirrer. The flask is purged with nitrogen and charged with 0.25 moles on nonanoyl chloride in 200 ml of dry toluene. Anhydrous p-phenol-sulfonate, monosodium salt (0.20 moles) is added as a powder, and the resulting mixture refluxed under nitrogen for 16 hours. The mixture is cooled to room temperature and diluted with 200 ml diethyl ether. The precipitated solid is collected by filtration and washed with 100 ml of diethyl ether. The solid is triturated with 200 ml of boiling methanol. After cooling, the solid is collected by filtration, washed with 100 ml of methanol, and dried under vacuum. NMR and cationic titration analyses shows the resulting nonanoyloxybenzenesulfonate, sodium salt (0.15 moles) to be over 98% pure.

EXAMPLE IV

Synthesis of (6-nonanamidocaproyl)oxybenzenesulfonate (NACA-OBS).

6-nonanamidocaproic Acid (NACA)—The reaction is carried out in a 12 L 3-necked flask equipped with a thermometer, addition funnel and mechanical stirrer. To a solution made from 212 g (5.3 moles) of sodium hydroxide and 6 L of water (cooled to room temperature) is added 694.3 g (5.3 moles) of 6-aminocaproic acid. This mixture is cooled to 10° C. and a solution of 694.3 g (5.3 moles) of nonanoyl chloride in 1 L of ether is added in a slow stream (about 2.5 hours) keeping the temperature at 10–15° C. During the addition, and subsequently until acidification, the reaction is maintained at pH 11–12 by periodic addition of 50% NaOH. After the addition is complete, the reaction is stirred for another 2 hours at 10° C. and allowed to come to room temperature before acidification to pH 1 with conc. HCl. The precipitated product is vacuum filtered, the filter cake is washed twice with 8 L portions of water and the product air dried overnight. It is then suspended in 3 L of hexane, filtered and washed with an additional 3 L of hexane. The product is then vacuum dried overnight (50° C., 1 mm) to give 1354 g (94%) of NACA.

Acid Chloride (NACA-Cl)—The reaction is carried out in a 5 L, 3-necked flask equipped with an addition funnel, mechanical stirrer and argon sweep. To a suspension of 542 g (2.0 moles) of NACA in 2 L of toluene is added (in a slow stream over 30 minutes) 476 g (4.0 moles) of thionyl chloride. This mixture is stirred at room temperature for four hours during which time the solids dissolve.

The solution is partially evaporated (30° C., 10 mm) to remove any excess thionyl chloride leaving 905 g of NACA-Cl/toluene solution (contains approximately 2 moles of NACA-Cl). An IR spectrum confirms conversion of COOH to COCl.

(6-nonanamidocaproyl)oxybenzenesulfonate (NACA-OBS)—The reactor is a 12 L, 3-necked flask equipped with a condenser, mechanical stirrer and static argon supply. To the reactor are added 647 g of the above NACA-Cl/toluene solution (1.43 moles), 6 L of toluene and 310.8 g (1.43 moles) of disodium p-phenolsulfonate (disodium p-phenolsulfonate is previously prepared and dried in a vacuum oven before use (110° C., 0.1 mm hg, 18 hours). This mixture is refluxed for 18 hours. After cooling to room temperature, the product is collected on a Buchner funnel and dried to give 725g of crude solids. The crude is taken up in 7 L of refluxing 87:13 (v,v) methanol/water, filtered hot and allowed to recrystallize at room temperature. The resulting precipitate is filtered and vacuum dried (50° C., 0.1 mm) for 18 hours to give 410 g (64% based on NACA) of light tan product. A trace of unreacted phenolsulfonate is indicated by the small doublets at 6.75 and 7.55 ppm in the $^1$H spectrum. Otherwise, the spectra are consistent with expected structure and no other impurities are evident.

EXAMPLE V

A granular detergent composition is prepared comprising the following ingredients.

| Component | Weight % |
|---|---|
| $C_{12}$ linear alkyl benzene sulfonate | 22 |
| Phosphate (as sodium triphosphate) | 30 |
| Sodium carbonate | 14 |
| Sodium silicate | 3 |
| Lipase | 0.3 |
| Sodium percarbonate | 5 |
| Ethylenediamine disuccinate chelant (EDDS) | 0.4 |
| Sodium sulfate | 5.5 |
| Nonanoyl caprolactam | 5 |
| Filler* and water | Balance to 100% |

*Can be selected from convenient materials such as $CaCO_3$, talc, clay, silicates, and the like.

In testing the bleaching performance and effect on natural rubber washing machine parts, the following test method is used:

Aqueous crutcher mixes of heat and alkali stable components of the detergent compositions are prepared and spray-dried and the other ingredients are admixed so that they contain the ingredients tabulated at the levels shown.

The detergent granules with bleach activator are added together with 5 lb. (2.3 kg) of previously laundered fabrics including natural rubber articles such as elastic materials, to an automatic washing machine equipped with a natural rubber sump hose. Actual weights of detergent and bleach activator are taken to provide a 950 ppm concentration of the former and 50 ppm concentration of the latter in the 17 gallon (65 l) water-fill machine. The water used has 7 grains/gallon hardness and a pH of 7 to 7.5 prior to (about 9 to about 10.5 after) addition of the detergent and bleaching system.

The fabrics are laundered at 35° C. (95° F.) for a full cycle (12 min.) and rinsed at 21 ° C. (70° F.). The laundering method is repeated for 2,000 wash cycles without rupture of, or significant damage to, the natural rubber parts or without damage to the natural rubber contained in the fabrics and with good enzyme performance.

EXAMPLE VI

A granular detergent composition is prepared comprising the following ingredients.

| Component | Weight % |
|---|---|
| Anionic alkyl sulfate | 7 |
| Nonionic surfactant | 5 |
| Zeolite (0.1–10 micron) | 10 |
| Trisodium citrate | 2 |
| SKS-6 silicate builder | 10 |
| Acrylate maleate polymer | 4 |
| Nonanoyl caprolactam | 5 |
| Sodium percarbonate* | 15 |
| Sodium carbonate | 5 |
| Ethylenediamine disuccinate chelant (EDDS) | 0.4 |
| Suds suppressor | 2 |
| Protease (as SAVINASE) | 0.3 |
| Lipase (as LIPOLASE) | 0.3 |
| Soil release agent | 0.2 |
| Minors, filler** and water | Balance to 100% |

*Average particle size of 400 to 1200 microns.
**Can be selected from convenient materials such as $CaCO_3$, talc, clay, silicates, and the like.

In testing the bleaching performance and effect on natural rubber washing machine parts, the following test method is used:

Aqueous crutcher mixes of heat and alkali stable components of the detergent composition are prepared and spray-dried, and the other ingredients are admixed so that they contain the ingredients tabulated at the levels shown.

The detergent granules with bleach activator are added via the dispensing drawer together with 5 lb. (2.3 kg) of previously laundered fabrics to an automatic washing machine equipped with a natural rubber sump hose. Actual weights of detergent and bleach activator are taken to provide a 8,000 ppm concentration of the former and 400 ppm concentration of the latter in the 17 l water-fill machine. The water used has 10 grains/gallon hardness and a pH of 7 to 7.5 prior to (about 9 to about 10.5 after) addition of the detergent and bleaching system.

The fabrics are laundered at 40° C. (104° F.) for a full cycle (40 min.) and rinsed at 21° C. (70° F). The laundering method is repeated for 2,000 wash cycles without rupture of, or significant damage to, the natural rubber parts and with good enzyme stability and performance.

EXAMPLE VII

A detergent composition is prepared by a procedure identical to that of Example VI, with the single exception that an equivalent amount of benzoyloxybenzene sulfonate is substituted for the nonanoyl caprolactam. The laundering method of Example VI is repeated for about 1200 cycles at which time the natural rubber parts ruptures.

EXAMPLE VIII

A detergent composition is prepared by a procedure identical to that of Example VI, with the single exception that an equivalent amount of nonanoyloxybenzenesulfonate (NOBS) is substituted for the nonanoyl caprolactam. The laundering method of Example VI is repeated for 1,200 cycles at about which time the natural rubber sump hose ruptures.

EXAMPLE IX

A detergent composition is prepared by a procedure identical to that of Example VI, with the single exception that an equivalent amount of (6-nonanamidocaproyl)-oxybenzenesulfonate as prepared in Example IV is substituted for the nonanoyl caprolactam. The laundering method of Example VI is repeated for 2000 cycles without rupture of, or significant damage to, the natural rubber parts and with good enzyme stability and performance.

EXAMPLE X

A detergent composition is prepared by a procedure identical to that of Example VI, with the exceptions that 15% of a 1:1:1 mixture of benzoyl caprolactam, nonanoyl caprolactam and (6-nonanamidocaproyl)oxybenzene-sulfonate as prepared following Example IV is substituted for the nonanoyl caprolactam and the amount of sodium percarbonate is 30%. The laundering method of Example VI is repeated for 2,000 cycles without rupture of, or significant damage to, the natural rubber parts and with good enzyme stability and performance.

EXAMPLE XI

A detergent composition is prepared by a procedure identical to that of Example V, with the exceptions that 20% of a 1:1 mixture of benzoyl caprolactam and (6-nonanamidocaproyl)oxybenzenesulfonate as prepared following Example IV is substituted for the nonanoyl caprolactam, the amount of sodium percarbonate is 20%, and the amount of phosphate is 0%. The laundering method of Example V is repeated for 2,000 cycles without rupture of, or significant damage to, the natural rubber parts and with good enzyme stability and performance.

EXAMPLE XII

A detergent composition is prepared by a procedure identical to that of Example VI, with the single exception that an equivalent amount of a benzoxazin-type activator is substituted for the nonanoyl caprolactam. The laundering method of Example VI is repeated for 2,000 cycles without rupture of, or significant damage to, the natural rubber parts and with good enzyme stability and performance.

EXAMPLE XIII

A detergent composition is prepared by a procedure identical to that of Example VI, with the exceptions that 10% of a 1:1 mixture of a benzoxazin-type activator and tetraacetyl ethylene diamine is substituted for the nonanoyl caprolactam and the amount of sodium percarbonate is 25%. The laundering method of Example VI is repeated for 2,000 cycles without rupture of, or significant damage to, the natural rubber parts and with good enzyme stability and performance.

EXAMPLE XIV

A detergent composition is prepared by a procedure identical to that of Example VI, with the single exception that 6% of a 1:1 mixture of benzoyl caprolactam and 3,5,5-trimethylhexanoyl caprolactam is substituted for the nonanoyl caprolactam bleach activator. The laundering method of Example VI is repeated for 2,000 cycles without rupture of, or significant damage to, the natural rubber parts.

EXAMPLE XV

A detergent composition is prepared by a procedure identical to that of Example VI, with the single exception that an equivalent amount of 3,5,5-trimethylhexanoyl caprolactam is substituted for the nonanoyl caprolactam. The laundering method of Example VI is repeated for 2,000 cycles without rupture of, or significant damage to, the natural rubber parts.

EXAMPLE XVI

A detergent composition is prepared by a procedure identical to that of Example VI, with the exceptions that 15% of a 1:1 mixture of benzoyl caprolactam and nonanoyl caprolactam is substituted for the nonanoyl caprolactam bleach activator and the amount of sodium percarbonate is 25%. The laundering method of Example VI is repeated for 2,000 cycles without rupture of, or significant damage to, the natural rubber parts.

EXAMPLE XVII

A detergent composition is prepared by a procedure identical to that of Example VI, with the exception that 15% of a 1:1 mixture of nonanoyl caprolactam and tetraacetyl ethylene diamine (TAED) is substituted for the nonanoyl caprolactam bleach activator and the amount of sodium percarbonate is 25%. The laundering method of Example VI is repeated for 2,000 cycles without rupture of, or significant damage to, the natural rubber parts.

EXAMPLE XVIII

A laundry bar suitable for hand-washing soiled fabrics is prepared by standard extrusion processes and comprises the following:

| Component | Weight % |
|---|---|
| $C_{12}$ linear alkyl benzene sulfonate | 30 |
| Phosphate (as sodium tripolyphosphate) | 7 |
| Sodium carbonate | 25 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| (6-nonanamidocaproyl)oxybenzenesulfonate | 5 |
| Sodium percarbonate | 5 |
| Brightener, perfume | 0.2 |
| Protease (as Protease C) | 0.3 |
| Lipase (as LIPOLASE) | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

EXAMPLE XIX

A detergent composition is prepared by a procedure identical to that of Example XVIII, with the single exception that an equivalent amount of benzoyl caprolactam is substituted for the (6-nonanamidocaproyl) oxybenzenesulfonate.

EXAMPLE XX

A detergent composition is prepared by a procedure identical to that of Example XVIII, with the single exception that an equivalent amount of nonanoyl caprolactam is substituted for the (6-nonanamidocaproyl) oxybenzenesulfonate.

EXAMPLE XXI

A granular detergent composition is prepared comprising the following ingredients.

| Component | Weight % |
|---|---|
| Anionic alkyl sulfate | 7 |
| Nonionic surfactant | 5 |
| Zeolite (0.1–10 micron) | 10 |
| Trisodium citrate | 2 |
| SKS-6 silicate builder | 10 |
| Acrylate maleate polymer | 4 |
| Nonanoyl caprolactam | 5 |
| Sodium percarbonate* | 15 |
| Sodium carbonate | 5 |
| Ethylenediamine disuccinate chelant (EDDS) | 0.4 |
| Suds suppressor | 2 |
| Protease (as Protease C) | 0.5 |
| Soil release agent | 0.2 |
| Minors, filler** and water | Balance to 100% |

*Average particle size of 400 to 1200 microns.
**Can be selected from convenient materials such as $CaCO_3$, talc, clay, silicates, and the like.

Aqueous crutcher mixes of heat and alkali stable components of the detergent composition are prepared and spray-dried, and the other ingredients are admixed so that they contain the ingredients tabulated at the levels shown.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXII

A detergent composition is prepared by a procedure identical to that of Example XXI, with the single exception that an equivalent amount of benzoyl caprolactam is substituted for the nonanoyl caprolactam.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXIII

A detergent composition is prepared by a procedure identical to that of Example XXI, with the exceptions that 15%, by weight, of (6-nonanamidocaproyl) oxybenzenesulfonate is substituted for the nonanoyl caprolactam and the amount of sodium percarbonate is 30%.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXIV

A detergent composition is prepared by a procedure identical to that of Example XXI, with the exceptions that 15%, by weight, of a 1:1 mixture of (6-nonanamidocaproyl) oxybenzenesulfonate and (6-decanamidocaproyl) oxybenzenesulfonate activator is substituted for the nonanoyl caprolactam and the amount of sodium percarbonate is 30%.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXV

A detergent composition is prepared by a procedure identical to that of Example XXI, with the exceptions that 15%, by weight, of a 1:1 mixture of (6-octanamidocaproyl) oxybenzenesulfonate and (6-decanamidocaproyl) oxybenzenesulfonate activator is substituted for the nonanoyl caprolactam and the amount of sodium percarbonate is 30%.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXVI

A detergent composition is prepared by a procedure identical to that of Example XXI, with the exceptions that 15%, by weight, of (6-octanamidocaproyl)-oxybenzenesulfonate is substituted for the nonanoyl caprolactam and the amount of sodium percarbonate is 30%.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXVII

A detergent composition is prepared by a procedure identical to that of Example XXI, with the exceptions that 15%, by weight, of (6-decanamidocaproyl)-oxybenzenesulfonate activator is substituted for the nonanoyl caprolactam and the amount of sodium percarbonate is 30%.

Testing is conducted following the procedures and methods in Example VI. The laundering method of Example VI is repeated for 2,000 cycles without rupture of, or significant damage to, the natural rubber parts and with good enzyme stability and performance.

EXAMPLE XXVIII

A bleaching system is prepared comprising the following ingredients.

| Component | Weight % |
|---|---|
| Nonanoyl caprolactam | 15 |
| Sodium percarbonate* | 25 |
| Ethylenediamine disuccinate chelant (EDDS) | 10 |
| Minors, filler** and water | Balance to 100% |

*Average particle size of 400 to 1200 microns.
**Can be selected from convenient materials such as $CaCO_3$, talc, clay, silicates, and the like.

The test method of Example V is repeated with the single exception that the above bleaching system is substituted for the detergent composition of Example V in an amount to provide a 500 ppm concentration in the 17 l water-fill machine. The laundering method of Example V is repeated for 2,000 wash cycles without rupture of, or significant damage to, the natural rubber parts.

EXAMPLE XXIX

A bleaching system is prepared comprising the following ingredients.

| Component | Weight % |
|---|---|
| Benzoyl caprolactam | 15 |
| Nonanoyloxybenzenesulfonafe | 15 |
| Sodium percarbonate | 45 |
| Chelant (ethylenediamine disuccinate, EDDS) | 10 |
| Filler* and water | Balance to 100% |

*Can be selected from convenient materials such as $CaCO_3$, talc, clay, silicates, and the like.

Testing is conducted following the methods used in Example VI with the single exception that the an equivalent amount of the above bleaching system is substituted for the detergent composition used in Example VI. In the test, fabrics exposed to the bleaching system display significantly improved whiteness after laundering compared with fabrics which have not been exposed to the bleaching system of the invention.

While the compositions and processes of the present invention are especially useful in conventional fabric laundering operations, it is to be understood that they are also useful in cleaning system which involves low water:fabric ratios. One such system is disclosed in U.S. Pat. No. 4,489,455, Spendel, issued Dec. 25, 1984, which involves a washing machine apparatus which contacts fabrics with wash water containing detersive ingredients using a low water: fabric ratio rather than the conventional method of immersing fabrics in an aqueous bath. The compositions herein provide excellent bleaching performance in such mechanical systems. Typically, the ratio of water:fabric ranges from about 0.5:1 to about 6:1 (liters of water:kg of fabric).

EXAMPLE XXX

A granular detergent composition is prepared comprising the following ingredients.

| Component | Weight % |
|---|---|
| Anionic alkyl sulfate | 7 |
| Nonionic surfactant | 5 |
| Zeolite (0.1–10 micron) | 10 |
| Trisodium citrate | 2 |
| SKS-6 silicate builder | 10 |
| Acrylate maleate polymer | 4 |
| Benzoyl caprolactam | 10 |
| Nonanoyloxybenzenesulfonate | 10 |
| Sodium percarbonate | 25 |
| Sodium carbonate | 5 |
| Ethylenediamine disuccinate chelant (EDDS) | 0.4 |
| Suds suppressor | 2 |
| Enzymes* | 1.5 |
| Soil release agent | 0.2 |
| Minors, filler** and water | Balance to 100% |

*1:1:1 mixture of protease, lipase, and cellulase.
**Can be selected from convenient materials such as $CaCO_3$, talc, clay, silicates, and the like.

Aqueous crutcher mixes of heat and alkali stable components of the detergent compositions are prepared and spray-dried. The other ingredients are admixed so that the detergent composition contains the ingredients tabulated at the levels shown.

The detergent granules with bleaching system are added together with a 2.7 kg (6 lb.) load of fabrics to an automatic washing machine. Actual weights of detergent and ester compositions are taken to provide a 5000 ppm concentration of the detergent composition in the 17 liter (4.5 gallon) water-fill machine. The water used has 7 grains/gallon hardness and a pH of 7 to 7.5 prior to (about 9 to about 10.5 after) addition of the detergent composition.

The fabrics are laundered at 40° C. (104° F.) for a full cycle (40 min.) and rinsed at 21° C. (70° F.).

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7\ L^2-40\ Lb)/700$$

The higher the value for W, the better the whiteness performance. In the above test, fabrics exposed to the bleaching system display significantly improved whiteness after laundering compared with fabrics which have not been exposed to the bleaching system of the invention.

Method of Processing the Bleach Activators

The bleach activators may be processed with a range of organic and inorganic substances to achieve a rapid dispersion in the bleaching liquor and to insure good stability in the detergent composition. The bleach activators are preferably employed in particulate form.

An example of preferred caprolactam bleach activator particles is an agglomerate of about 65%, by weight, benzoyl caprolactam; about 7% of a builder, such as aluminium silicate; about 15% sodium carbonate; about 9% dispersant, such as a polyacrylate polymer; and about 4% of a solubilizing agent, such as a linear alkyl sulfonate. Another example of a preferred caprolactam bleach activator particle is an agglomerate of about 80% to about 85%, by weight, benzoyl caprolactam and about 15% to about 20% of a binder, such as tallow alcohol ethoxylate, preferably TAE25.

An example of a preferred amido-derived bleach activator particle comprises a 1:1:1 mixture of (6-octanamidocaproyl) oxybenzenesulfonate, (6-decanamidocaproyl)-oxybenzenesulfonate, and citric acid powder. The mixture is intimately mixed in a food mixer for 5–10 minutes. To the resultant mixture is added tallow alcohol ethoxylate (TAE25) nonionic surfactant at 50° C. until granules are formed. Typically successful granulations are achieved with a ratio of bleach activator/citric acid solid mixtures:nonionic binding agent of 3.5:1. The resultant granules, ellipsodial and spherical in shape, are white and free flowing.

A typical particle composition is about 40% to about 60%, preferably about 55%, by weight, of the bleach activator or mixture of bleach activators; about 20% to about 40%, preferably about 25%, by weight, of citric acid; and about 15% to about 30%, preferably about 20%, by weight, TAE25 binding agent. Alternatively, a 2:1 mixture of (6-decanamidocaproyl)oxybenzenesulfonate and citric acid powder may be used. In this case, the composition on the granule is 55% bleach activator, 25% citric acid, and 20% TAE25 binding agent. Other preferred organic binding agents include anionic surfactants ($C_{12}$ linear alkyl benzene sulfonates), polyethylene glycols, and TAE50.

Another example of a preferred amido-derived bleach activator particle comprises a 1:1:1 mixture of (6-octanamidocaproyl)oxybenzenesulfonate, (6-decanamidocaproyl)oxybenzenesulfonate, and sodium hydrogen sulfate. To the mixture is added 20% by weight of an anionic surfactant (alkyl sulfate is particularly perferred). The components are mixed into a paste with water, typically 30–50% by weight of water being added, and introduced into an air flow such that droplets are formed. This techinque is comrnonly known as spray drying. This may be achieved using, for example a Nyro atomiser, or a spray gun. Hot air (typically 150–300 degree Celisius) is blasted upwards through a column. The resulting particles formed are collected at the bottom of the column and classified into desired size.

A typical particle composition is about 40–60%, preferably about 55%, by weight of the bleach activator or mixture of activators, about 20–40%, preferably about 25%, of sodium hydrogen sulfate, and about 15–25%, preferably about 20%, of anionic surfactant. Alternatively, a 2:1 mixture of (6-decanamidocaproyl)oxybenzenesulfonate and sodium hydrogen sulfate may be used. Citric acid or boric acid may also be used in place of sodium hydrogen sulfate in the above examples.

The particle size of the resulting granules may be varied according to the desired performance/stability. Fine particles (<250 um) show improved solubility; though coarse particles (>1180 um) are more stable in high temperatures/moist environments. A typical, preferred particle size range is 250–1180 um; particles conforming to this specification show excellent stability and solubility.

What is claimed is:

1. A bleaching system composition comprising at least about 0.1% by weight of a peroxygen bleaching compound capable of yielding hydrogen peroxide in an aqueous liquor and at least 0. 1% by weight of one or more bleach activators, wherein said bleach activators are members selected from the group consisting of:

a) a bleach activator of the general formula:

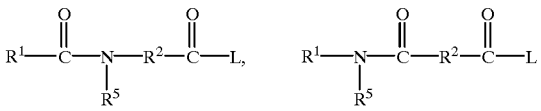

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group selected from the group consisting of:

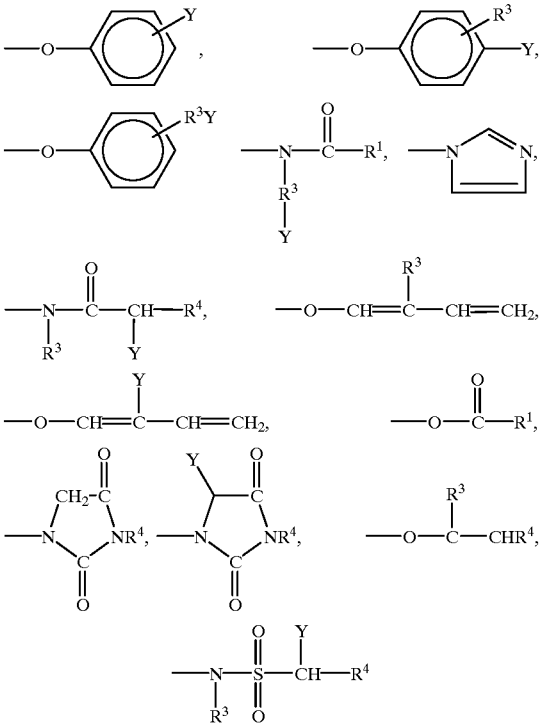

and mixtures thereof, wherein $R^1$ is an alkyl, aryl or alkaryl group containing from about 1 to about 14 carbon atoms, $R^3$ is an alkyl chain containing from 1 to about 8 carbon atoms, $R^4$ is H or $R^3$, and Y is H or a solubilizing grou selected from the group consisting of: $—SO_3^-M^+$, $—CO_2^-M^+$, $—SO_4^{4}M^4$, $—N^+(R^3)_4X^-$ and $O<—N(R^3)_3$ wherein $R^3$ is an alkyl chain containing from about 1 to about 4 carbon atoms, M is a cation which provides solubility to the bleach activator and X is an anion which provides solubility to the bleach activator;

b) a benzoxazin bleach activator of the formula:

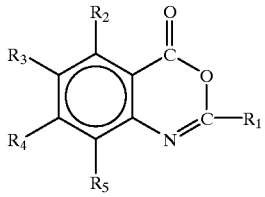

wherein $R_1$ is H, alkyl, alkaryl, aryl, arylalkyl, and wherein $R_2$, $R_3$, $R_4$, and $R_5$ are the same or different substituents selected from H, halogen, alkyl, alkenyl, aryl, hydroxyl, alkoxyl, amino, alkylamino, $—COOR_6$, wherein $R_6$ is H or an alkyl group and carbonyl functions;

c) a N-acyl caprolactam bleach activator of the formula:

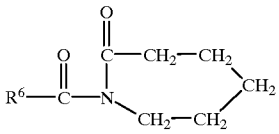

wherein $R^6$ is H or an alkyl, aryl, alkoxyaryl, or alkaryl group containing from 1 to 12 carbons provided that said N-acyl caprolactam activator comprises a hydrophilic N-acyl caprolactam activator where $R^6$ contains from about 1 to about 6 carbon atoms and a hydrophobic N-acyl caprolactam activator where $R^6$ contains at least 6 carbon atoms wherein said hydrophilic and hydrophobic are different N-acyl caprolactam activators; and d) mixtures of a), b) and c).

2. A composition according to claim 1 wherein said composition further comprises at least about 0.001%, by weight of said composition of enzyme and said enzyme is selected from the group consisting of proteases, amylases, lipases, cellulases, and peroxidases and mixtures thereof.

3. A composition according to claim 2 wherein said enzyme is lipase derived from the fungus *Humicola lanuginosa*.

4. A composition according to claim 2 wherein said enzyme is modified bacterial serine protease derived from *Bacillus subtilis, Bacillus lentus*, or *Bacillus licheniformis*.

5. A composition according to claim 2 wherein said bleach activator is selected from the group consisting of:

a) a bleach activator of the formula:

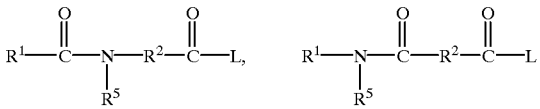

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group selected from the group consisting of:

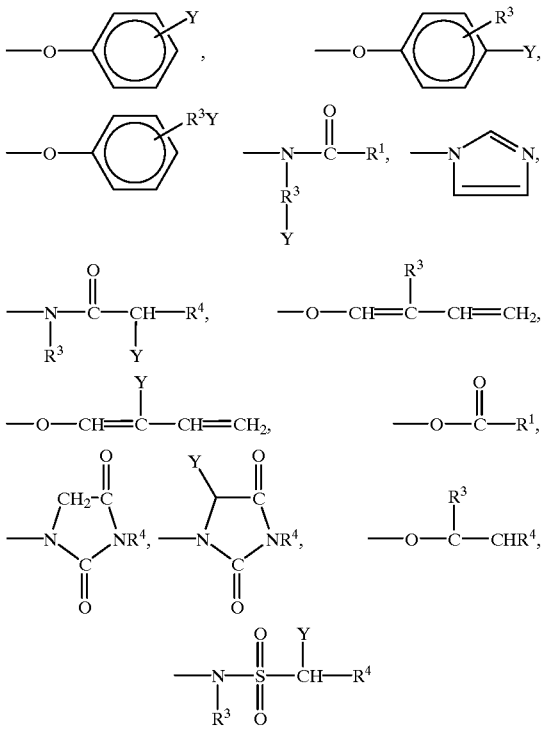

and mixtures thereof wherein $R^1$ is an alkyl, aryl or alkaryl group containing from about 1 to about 14 carbon atoms, $R^3$ is an alkyl chain containing from 1 to about 8 carbon atoms, $R^4$ is H or $R^3$ and Y is H or a solubilizing group selected from the group consisting of: $—SO_3^-M^+$, $—CO_2^-M^+$, $—SO_4^-M^+$, $—N^+(R^3)_4X^-$ and $O<—N(R^3)_3$ wherein $R^3$ is an alkyl chain containing from about 1 to about 4 carbon atoms, M is a cation which provides solubility to the bleach activator and X is an anion which provides solubility to the bleach activator;

b) a N-acyl caprolactam bleach activator of the formula:

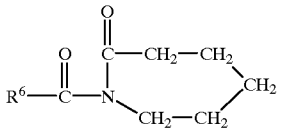

wherein $R^6$ is H or an alkyl, aryl, alkoxyaryl, or alkaryl group containing from about 1 to about 12 carbons provided that said N-acyl caprolactam activator comprises a hydrophilic N-acyl caprolactam activator where $R^6$ contains from about 1 to about 6 carbon atoms and a hydrophobic N-acyl caprolactam activator where $R^6$ contains at least 6 carbon atoms wherein said hydrophilic and hydrophobic are different N-acyl caprolactam activators and c) mixtures of a) and b);

and said enzyme is selected from the group consisting of modified bacterial serine proteases derived from *Bacillus subtilis, Bacillus lentus, Bacillus licheniformis* and mixtures thereof.

6. A composition according to claim 2 wherein said bleaching system composition comprises a bleach activator selected from the group consisting of benzoyl caprolactam and nonanoyl caprolactam, (6-octanamidocaproyl) oxybenzenesulfonate,(6-nonanamidocaproyl) oxybenzenesulfonate, (6-decanamido caproyl) oxybenzenesulfonate, and mixtures thereof.

7. A composition according to claim 6 wherein the bleach activators are in particulate form.

8. A composition according to claim 7 wherein the bleach activators are spray dried particles.

9. A composition according to claim 1 wherein the peroxygen bleaching compound is selected from the group consisting of sodium perborate monohydrate, sodium perborate tetrahydrate, sodium pyrophosphate peroxyhydrate, urea peroxyhydrate, sodium percarbonate, sodium peroxide and mixtures thereof.

10. A composition according to claim 9 wherein the molar ratio of hydrogen peroxide to bleach activator is greater than about 1.0.

11. A composition according to claim 1 wherein $R^1$ is an alkyl group containing from about 6 to about 12 carbon atoms, $R^2$ contains from about 1 to about 8 carbon atoms, and $R^5$ is H or methyl.

12. A composition according to claim 11 wherein $R^1$ is an alkyl group containing from about 7 to about 10 carbon atoms and $R^2$ contains from about 4 to about 5 carbon atoms.

13. A detergent composition comprising:

a) at least about 0.001% of enzymes selected from the group consisting of proteases, amylases, lipases, cellulases, peroxidases and mixtures thereof; and b) a bleaching system comprising at least about 0.1% by weight of a substantially insoluble organic peroxyacid having the general formula:

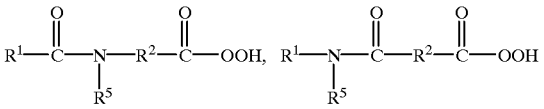

wherein $R^1$ is an alkyl, aryl, or alkaryl group containing from about 1 to about 14 carbon atoms, R2 is an alkylene, arylene or alkarylene group containing from about 1 to about 14 carbon atoms, $R^5$ is H or an alkyl, aryl, or alkaryl group containing from about 1 to about 10 carbon atoms.

14. A bleaching system composition comprising at least about 0.1% by weight of a peroxygen bleaching compound capable of yielding hydrogen peroxide in an aqueous liquor and at least 0.1% by weight of one or more bleach activators selected from the group consisting of: nonanoyl caprolactam, 3,5,5-trimethylhexanoyl caprolactam, decanoyl caprolactam, undecenoyl caprolactam, nonanoyl caprolactam, (6-octanamidocaproyl)oxybenzenesulfonate, (6-nonanamidocaproyl) oxybenzenesulfonate, (6-decanamidocaproyl)oxybenzenesulfonate and mixtures thereof.

15. A composition according to claim 12 wherein Y is selected from the group consisting of $—SO_3M^+$, $—CO_2^-M^+$ and mixtures thereof wherein M is selected from the group consisting of sodium, potassium and mixtures thereof.

16. A composition according to claim 15 wherein L is selected from the group consisting of:

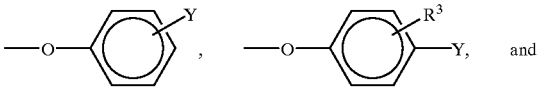

-continued

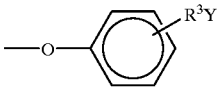

wherein $R^3$ is an alkyl chain containing from about 1 to about 8 carbon atoms, Y is $—SO_3^-M^+$ or $—CO_2^-M^+$ wherein M is sodium or potassium.

17. A composition according to claim 1 wherein said N-acyl caprolactam activator comprises a hydrophobic N-acyl caprolactam activator selected from the group consisting of benzoyl caprolactam, octanoyl caprolactam, nonanoyl caprolactam, 3,5,5-trimethylhexanoyl caprolactam, decanoyl caprolactam, undecenoyl caprolactam, and mixtures thereof.

18. A composition according to claim 1 wherein said bleach system composition comprises a hydrophilic N-acyl caprolactam activator where $R^6$ contains from about 1 to about 6 carbon atoms and wherein said composition further comprises at least about 0.1% by weight of an alkanoyloxybenzenesulfonate bleach activator.

19. A composition according to claim 18 wherein the hydrophilic N-acyl caprolactam activator is selected from the group consisting of benzoyl caprolactam, formyl caprolactam, acetyl caprolactam, propanoyl caprolactam, butanoyl caprolactam, pentanoyl caprolactam, and hexanoyl caprolactam.

20. A composition according to claim 18 wherein the alkanoyloxybenzenesulfonate is selected from the group consisting of nonanoyloxybenzenesulfonate, decanoyloxybenzenesulfonate, octanoyloxybenzenesulfonate, dodecanoyloxybenzene-sulfonate, 5 3,5,5-trimethylhexanoyloxybenzenesulfonate, 2-ethylhexanoyloxybenzenesulfonate, and mixtures thereof.

21. A composition according to claim 1 wherein said bleaching system composition further comprises a hydrophilic bleach activator non N-acyl caprolactam bleach activator.

22. A composition according to claim 1 wherein $R^6$ is a member selected from the group consisting of phenyl, heptyl, octyl, nonyl, decenyl, and 2,4,4-trimethylpentyl substituents.

23. A composition according to claim 1 wherein the hydrophilic bleach activator is a caprolactam activator where $R^6$ contains less than 6 carbon atoms.

24. A composition according to claim 21 wherein the hydrophilic bleach activator is tetraacetyl ethylene diamine.

25. A composition according to claim 1 wherein said benzoxazin bleach activator has the formula:

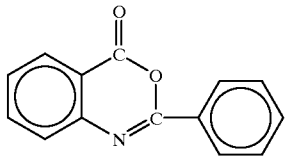

.

26. A composition according to claim 1 further comprising from about 5% to about 80%, by weight, of a detersive surfactant.

27. A composition according to claim 26 further comprising from about 5% to about 80%, by weight, of a detersive builder and from 0% to about 20%, by weight, of conventional detersive adjuncts.

28. A composition according to claim 13 wherein said enzyme is lipase derived from the fungus *Humicola lanuginosa*.

29. A composition according to claim 13 wherein said enzyme is modified basterial serine protease derived from *Bacillus subtilis, Bacillus lentus,* or *Bacillus licheniformis.*

30. A composition according to claim 13 further comprising from about 5% to about 80%, by weight, of a detersive surfactant, from about 5% to about 80%, by weight, of a detersive builder and from 0% to about 20%, by weight, of conventional detersive adjuncts.

* * * * *

UNITED STATES PATENT AND TRADEMARK OFFICE
CERTIFICATE OF CORRECTION

PATENT NO. : 5,998,350

DATED : December 7, 1999

INVENTOR(S) : Michael Eugene Burns et al.

It is certified that error appears in the above-identified patent and that said Letters Patent is hereby corrected as shown below:

Column 2, line 58 of the issued patent should read --benzoxazin-type bleach activators --.

Column 4, line 47 of the issued patent should read -- 12 carbon atoms --.

Column 17, line 20 of the issued patent should read -- two litre --.

Column 17, line 24 of the issued patent should read -- 1 litre --.

Column 17, line 38 of the issued patent should read -- two litre --.

Column 17, line 42 of the issued patent should read -- 1 litre --.

Column 17, line 41 of the issued patent should read -- triethylamine --.

Column 19, line 8 of the issued patent should read -- (as sodium tripolyphosphate) --.

Column 26, line 43 of the issued patent should read -- is commonly known --.

Column 27, line 60 of the issued patent should read -- solubilizing group --.

Column 27, line 61 of the issued patent should read -- $—SO_3^-M^+$, $—CO_2^-M^+$, $—SO_4^-M^+$ --.

Column 31, line 31 (Claim 20) of the issued patent should read -- dodecanoyloxybenzene-sulfonate, 3,5,5- --.

Column 32, line 31 (Claim 29) of the issued patent should read -- bacterial serine --.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*